US009090442B2

(12) United States Patent
Abell

(10) Patent No.: US 9,090,442 B2
(45) Date of Patent: Jul. 28, 2015

(54) FLEXIBLE POURING SPOUT

(75) Inventor: Cameron Abell, Nanaimo (CA)

(73) Assignee: MARVEL INNOVATIONS INC., Vancouver (CA)

( * ) Notice: Subject to any disclaimer, the term of this patent is extended or adjusted under 35 U.S.C. 154(b) by 39 days.

(21) Appl. No.: 13/816,491

(22) PCT Filed: Aug. 12, 2011

(86) PCT No.: PCT/CA2011/000915

§ 371 (c)(1), (2), (4) Date: Feb. 12, 2013

(87) PCT Pub. No.: WO2012/019289

PCT Pub. Date: Feb. 16, 2012

(65) Prior Publication Data

US 2013/0140334 A1 Jun. 6, 2013

Related U.S. Application Data

(60) Provisional application No. 61/373,228, filed on Aug. 12, 2010.

(51) Int. Cl.

| | |
|---|---|
| ***B67D 7/06*** | (2010.01) |
| ***B67D 7/00*** | (2010.01) |
| ***B65D 25/48*** | (2006.01) |

(52) U.S. Cl.

CPC ..... *B67D 7/005* (2013.01); *B65D 25/48* (2013.01)

(58) Field of Classification Search

CPC ..... B65D 47/061–47/063; B65D 47/066; B65D 25/465; B65D 25/48

USPC ..... 222/527–530, 568, 461, 481.5; 141/331, 332, 337, 382, 387–389; 251/155, 321, 354

See application file for complete search history.

(56) References Cited

U.S. PATENT DOCUMENTS

| | | | | | |
|---|---|---|---|---|---|
| 196,084 | A | * | 10/1877 | Guyer | 285/148.11 |
| 1,913,895 | A | * | 6/1933 | Paull | 222/487 |
| 2,556,627 | A | * | 6/1951 | Miksis | 222/568 |
| 4,583,668 | A | * | 4/1986 | Maynard, Jr. | 222/529 |
| 5,020,702 | A | * | 6/1991 | James | 222/529 |
| 5,186,358 | A | * | 2/1993 | McVay | 222/1 |
| 5,350,091 | A | * | 9/1994 | Leete et al. | 222/529 |
| 5,560,522 | A | * | 10/1996 | Clark | 222/481.5 |
| 5,934,522 | A | * | 8/1999 | Canela et al. | 222/527 |
| 6,450,219 | B1 | * | 9/2002 | Ingram | 141/333 |
| 2011/0127293 | A1 | * | 6/2011 | Pascatore | 222/1 |

* cited by examiner

*Primary Examiner* — Kevin P Shaver
*Assistant Examiner* — Nicholas J Weiss

(57) ABSTRACT

A flexible pouring spout of segmented tubing having an internally threaded adapter cap at one end for connecting with a threaded neck of a fluid container, and an externally threaded terminal end which is adapted to connecting with the adapter cap thereby enabling the device to form a loop of itself. Thus, the interior of the spout remains clean even if it has a sticky or oily substance thereon, and any fluid within the device is retained therein. Also provided is a sealable air inlet valve for allowing air to be drawn into the spout when in use to prevent fluid lock in the device and bottle collapse, and to facilitate rapid and efficient pouring of the fluid from its container.

9 Claims, 6 Drawing Sheets

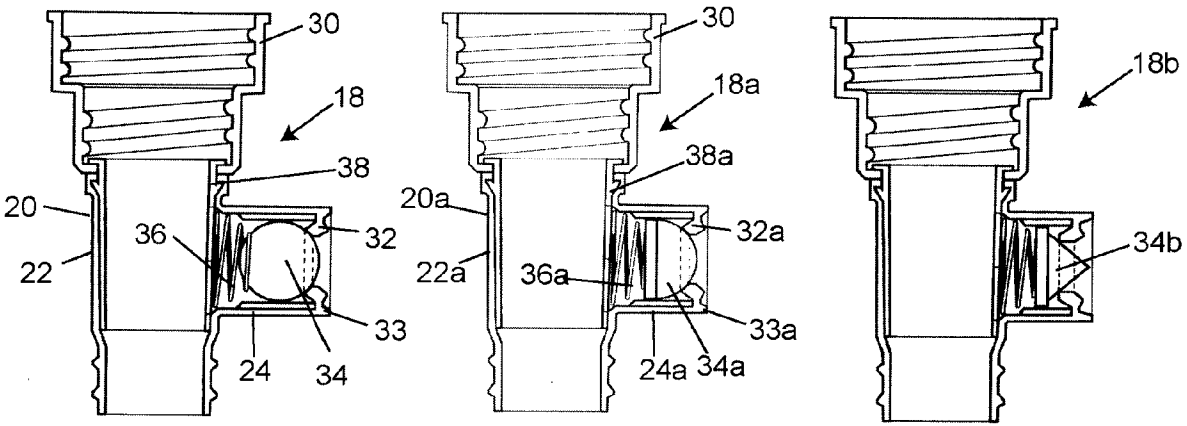
Fig. 7
Fig. 6
Fig. 5
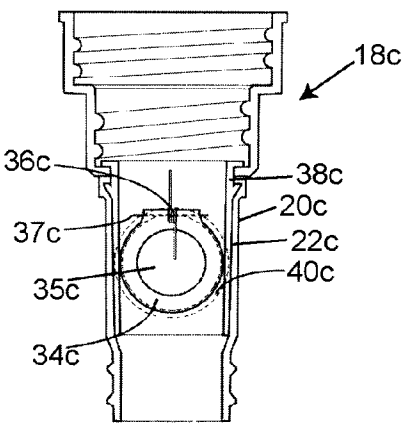
Fig. 9
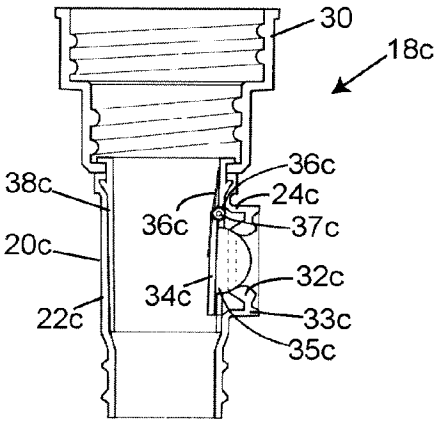
Fig. 8

FLEXIBLE POURING SPOUT

BACKGROUND OF THE INVENTION

1. Field of the Invention

The present invention generally relates to spouts and funnels for fluids, and more particularly to elongate flexible pouring spouts for pouring fluid from a container into relatively narrow orifice or opening, such as for example, pouring automotive fluids from their containers into receptacles for same on motor vehicles.

2. Description of Related Art

One difficulty with some prior art funnels or elongated flexible pouring spouts is that they frequently become contaminated, particularly if they are used with some sticky substance such as oil, coolant and the like. When such spout is not in use, the oily surface of the interior attracts and retains dust and dirt so that the next time the spout or funnel is used, the oil or other liquid becomes contaminated. Further, when such flexible spouts or funnels are hung up for storage, they tend to drip and cause unsightly stains and contamination of the underlying surface by the fluid. A further drawback of some of the prior art spouts or funnels is that they are not adapted to fit closely to the mouth of the container from which the fluid is poured, thus spills are frequent when either the spout or container is inadvertently moved, resulting in an inconvenience to the user for having to clean up the spill or a detrimental environmental impact in the case of oils and coolants leaking into the ground. Yet another drawback of some of the prior art spouts or funnels is that they often become fluid locked as a result of the inability to efficiently draw air into their fluid passageway once said passageway becomes blocked with the fluid, resulting in slow fluid flow through the device.

SUMMARY OF THE INVENTION

In order to address some of the shortcomings in the prior art, some aspects of the present invention provide a flexible pour spout made of a flexible, tubing having a first end provided with an internally threaded adapter cap for connecting with a threaded neck of a fluid container, and an externally threaded terminal end which is adapted to connecting with the adapter cap on the flexible pour spout (when not in use) thereby forming a loop of itself. Thus, the interior of the spout remains clean even if it has a sticky or oily substance thereon, and since the spouts of the present invention form a loop when coupled to themselves, they are easy to hang up for storage and do not drip. The flexible pouring spouts of the present invention are also provided with a sealable air inlet valve or a spring biased one-way air inlet valve for allowing air to be drawn into the spout when in use to aid in rapid fluid flow through the device. In the case of a spring biased one-way air inlet valve, the valve is drawn open as a result of the negative pressure created by the flow of fluid through the spout, but which is allowed to close in the absence of such negative pressure in the spout to limit the escape of fluid from the air inlet means. The air inlet means thereby prevents a fluid lock and bottle collapse, and facilitates very rapid and efficient pouring of the fluid from its container.

In some embodiments, the flexible pouring spout of the present invention is also provided with a segmented flexible tubing in a configuration that enables articulation of the tubing.

In some embodiments, the present invention provides a flexible pour spout for pouring fluids from a container with a threaded neck portion into an orifice, the flexible pour spout comprising a container adapter having a first threaded portion having internal threads and being adapted to connecting with the threaded neck portion of the fluid container; a hollow body connected to the container adapter and in fluid communication therewith; an elongate flexible tube having a first end connected to the hollow body and in fluid communication therewith, and a terminal end being suitable for insertion into an orifice, the tube having a length sufficient to enable the terminal end to being inserted into the container adapter when the device is not in use, thereby defining a storage configuration; a sealable air inlet valve connected to the hollow body that allows air to be drawn into the device when the air inlet valve is open to facilitate a rapid flow of fluid through the device, and which prevents the escape of fluid through the air inlet valve when it is closed; and a connector portion attached to the terminal end and having external threads that are adapted to engage the internal threads of the container adapter when the terminal end is inserted into the container adapter in a manner that provides a fluid tight seal between the container adapter and the connector portion, or between the container adapter and the terminal end, to prevent fluid from escaping from the device when it is in the storage configuration.

In some embodiments, the sealable air inlet valve may comprise a spring biased one-way inlet valve which allows air to be drawn into the device as a result of a negative pressure generated by fluid flowing through the device that overcomes a biasing force of the spring tending to close the valve, and which closes in the absence of fluid flowing through the device to limit the escape of fluid from the device via the valve.

In some embodiments, the container adapter may include a second threaded portion having internal threads of different size from the first threaded portion and being adapted to connecting with a different sized threaded neck of a fluid container than the first threaded portion.

In some embodiments, the container adapter may be rotatably connected to the hollow body in a manner that provides a fluid tight seal between them but which enables the container adapter to rotate relative to the rest of the device to facilitate connecting the container adapter to a container when the device is intended to be used, or to the connector portion when the device is intended to be stored.

In some embodiments, a sealing cap may be provided that cooperates with the sealable air inlet valve and that is moveable between an open position in which it allows air to be drawn into the valve and a closed position in which it seals the valve to prevent fluid escape.

In some embodiments, the elongate flexible tube may comprise a first flexible corrugated portion adjacent the first end, a second flexible corrugated portion adjacent the terminal end, and a resilient straight portion in between said first and second corrugated portions to maintain the device in a generally oval shape when in the storage configuration.

The embodiments of the present invention are generally adapted for use in pouring fluid from a container having an externally threaded neck. Particularly, the flexible pouring spouts are suited for pouring oil from a typical oil container, such as at service stations, where the oil must be frequently poured into a relatively small or inaccessible opening or orifice in a motor vehicle engine.

Various other features, objects, and advantages of the invention will be made apparent from the following description taken together with the drawings.

BRIEF DESCRIPTION OF THE DRAWINGS

For a better understanding of the present invention and to show more clearly how it may be carried into effect, reference is made by way of example to the accompanying drawings in which:

FIG. 5 is a side longitudinal section view of a breather valve assembly of the flexible pouring spout of FIG. 1 shown connected to a duplex adapter cap;

FIG. 6 is a side longitudinal section view of another embodiment of a breather valve assembly shown connected to a duplex adapter cap;

FIG. 7 is a side longitudinal section view of another embodiment of a breather valve assembly shown connected to a duplex adapter cap;

FIG. 8 is a side longitudinal section view of another embodiment of a breather valve assembly shown connected to a duplex adapter cap;

FIG. 9 is a back longitudinal section view of a breather valve assembly of FIG. 8 shown connected to a duplex adapter cap;

DETAILED DESCRIPTION OF THE INVENTION

Figure 1:
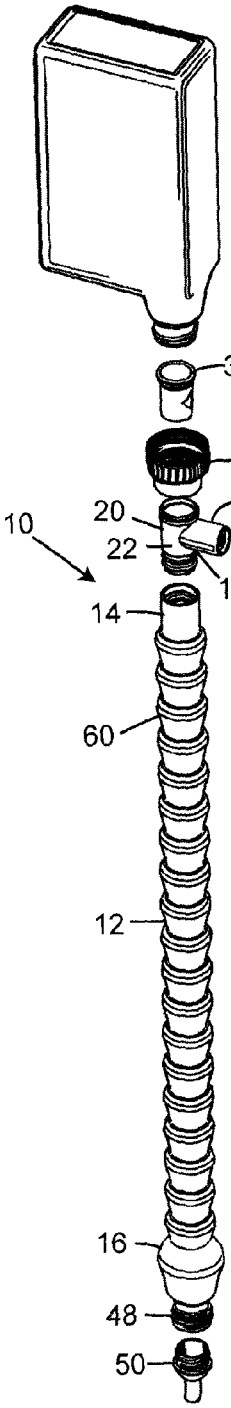
FIG. 1 is an exploded perspective view of an embodiment of a flexible pouring spout in accordance with the present invention shown with a typical motor oil container having a threaded neck.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring to the drawings and particularly FIGS. 1-5, by reference characters, the flexible pouring spout 10 of the present invention includes a length of a flexible hose or tubing 12 having a first end such as inlet end 14 and terminal end such as outlet end 16. The flexible tubing 12 may be a convoluted plastic or rubber tubing (as illustrated) although it could be made of various materials and, of course, the material of which it is made must be selected to be inert to the fluid for which the spout is intended to be used. The flexible tubing comprises a plurality of segments 60 joined to each other that enables the tubing to be articulated.

At the inlet end 14, the flexible tubing is connected to a hollow body such as breather valve assembly 18. In the embodiment illustrated in FIGS. 1-5, the breather valve assembly 18 comprises a T-junction tube 20 comprising of a longitudinal tube portion 22 and lateral tube portion 24 which are in fluid communication. The bottom end of the longitudinal tube portion 22 is connected to the inlet end 14 by means of complementary threads on the respective structures in the illustrated embodiments, although other ways of connecting them may be used as would hereafter be apparent to the skilled reader.

The top end of the longitudinal tube portion 22 is connected to a bottle or container adapter such as duplex adapter cap 30 which has two (first and second) internal threaded portions of different diameters, each matching the most commonly used oil container neck diameters and thread patterns, thereby enabling the duplex adapter cap 30 (hence the pouring spout 10) to be integrally connected to such popular oil containers. While the adapter cap 30 is shown having two internal threaded portions, this is not a requirement and other embodiments of the present invention may have an adapter cap with only one internally threaded portion, or with more than two internally threaded portions.

The inside of the lateral tube portion 24 is provided with an annular sealing flange 32 towards the open outer end 33. A ball 34 within the lateral tube portion 24 is seated against the sealing flange 32 as a result of a biasing force provided by spring 36. The base of the spring 36 is seated against a retainer sleeve 38 that is snap-fit into the longitudinal tube portion 22. The retainer sleeve 38 includes a port 40 that is adjacent the lateral tube portion 22 and allows fluid communication between the lateral tube portion 24 and the longitudinal tube portion 22. Either the sealing flange 32, the ball 34, or both are preferably made of an elastomeric material to provide for an enhanced seal between them. The spring 36 is one that provides sufficient biasing force to seat the ball 34 against the sealing flange 32 under ambient conditions, but which allows the ball 34 to be drawn inwardly away from the sealing flange 32 as a result of negative pressure in the spout 10 caused by fluid flowing therethrough. Consequently, the breather valve assembly 18 functions to allow air to be drawn into the spout 10 to relieve any negative pressures within the spout, thereby preventing fluid lock in the spout and container.

Figure 2:
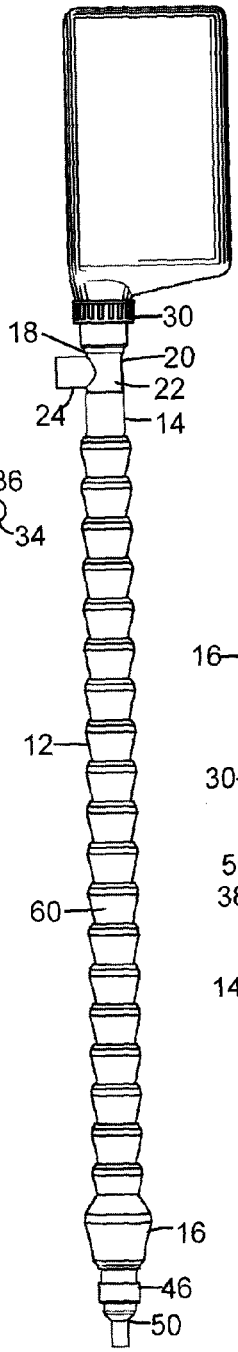
FIG. 2 is a perspective view of the flexible pouring spout of FIG. 1 shown operably connected to an oil container.
Figure 3:
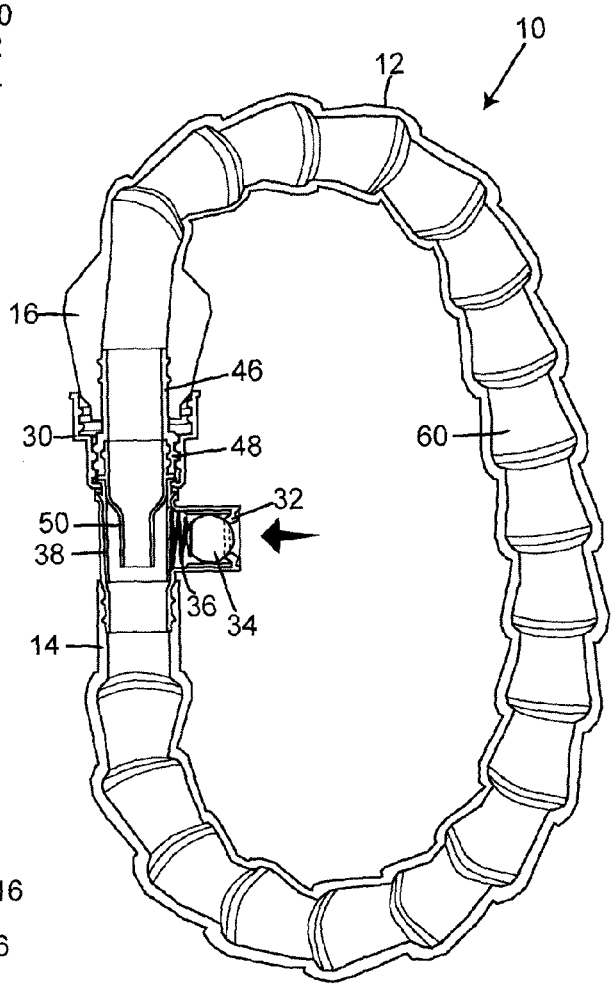
FIG. 3 is a longitudinal section view of the flexible pouring spout of FIG. 1 showing how the device is coupled to itself to form a loop in the storage configuration.
Figure 4:
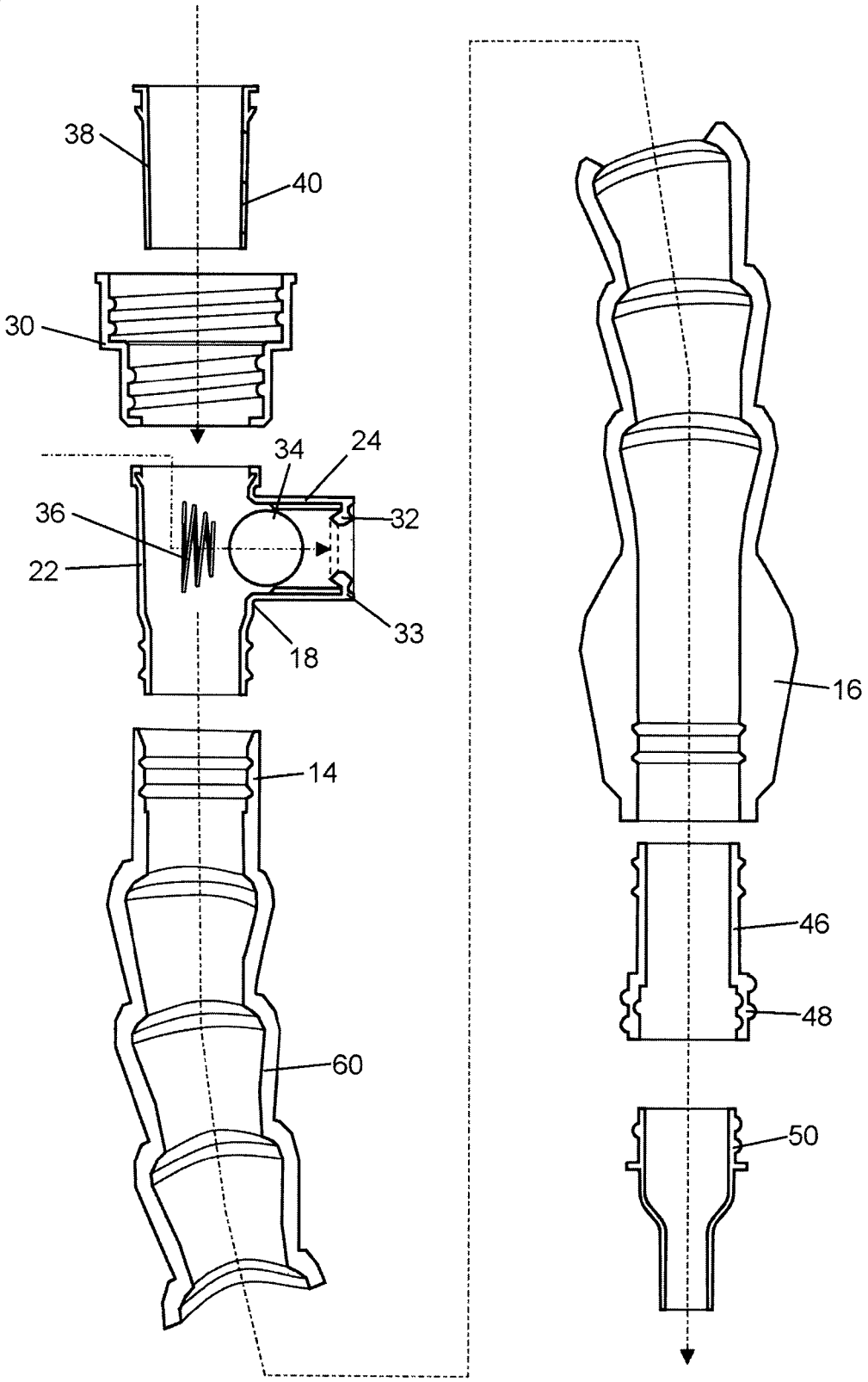
FIG. 4 is an exploded longitudinal section view of the flexible pouring spout of FIG. 1.
Figure 10:
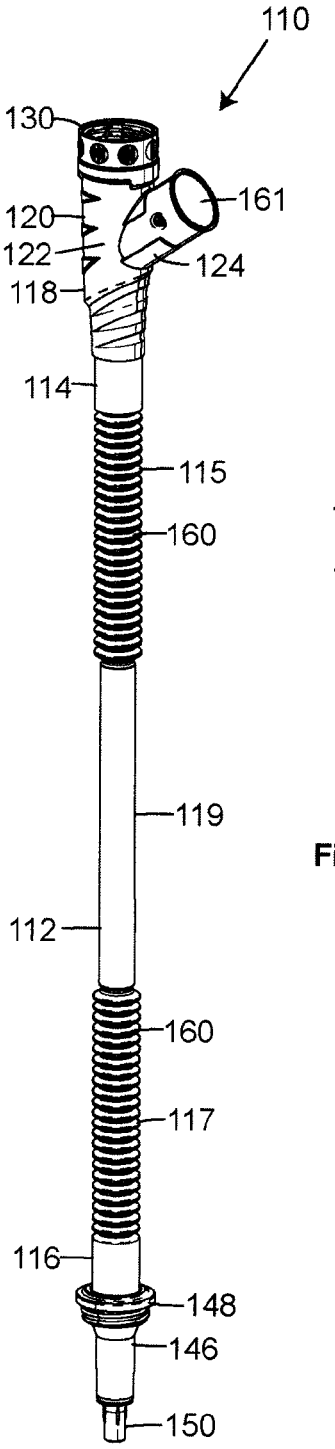
FIG. 10 is a perspective view of another embodiment of a flexible pouring spout in accordance with the present invention.
Figure 12:
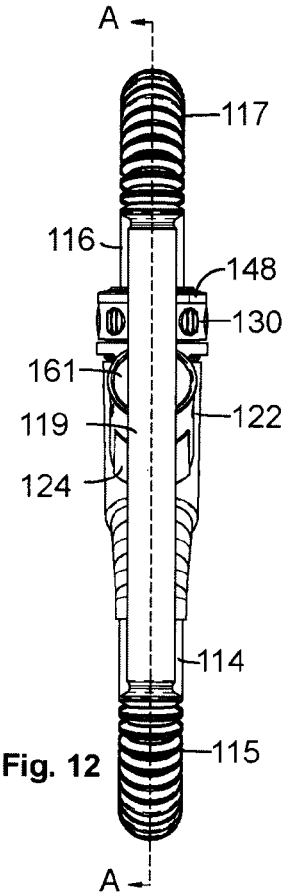
FIG. 12 is a front view of the flexible pouring spout shown in FIG. 11.

The flexible tubing 12 terminates in outlet end 16 that is suitably larger than the tubing and smooth (not convoluted) for easy insertion in an opening of a fluid receptacle on the vehicle or the like. The outlet end 16 connects to a spout end 46 having a connector portion such as externally threaded portion 48 which is adapted to being threaded to the duplex adapter cap 30 such that the spout 10 may be coupled to itself to form a loop, thereby enclosing its internal surfaces when the spout 10 is not in use, as show in FIG. 3. In this storage configuration the interior of the spout 10 will be sealed and thus not be in contact with ambient dust or the like. Further, if these surfaces are oily, there will be no tendency for the liquid to drip from the spout 10, even when it is hung up or otherwise stored. To use the spout 10 again, it is only necessary to unthread the spout end 46 from the duplex adapter cap 30 (such as by twisting the device) and connect the adapter cap to the neck of an oil container as is shown in FIG. 2.

The spout end 46 may be clear (i.e. comprised of a clear plastic) to enable a user to monitor the flow of fluid through the spout 10 and to know when the fluid container becomes empty. A transmission fluid end spout 50 having an elongate nozzle portion may also be provided for ease of filling transmissions with oil. The transmission fluid end spout 50 may be connectible to the spout end 46 or the outlet end 16, and it may also be clear.

Referring now to FIGS. 6-9, there are shown other embodiments of the breather valve in the breather valve assembly.

In FIG. 6, the breather valve assembly 18*a* is shown, and comprises a T-junction tube 20*a* comprising of a longitudinal tube portion 22*a* and lateral tube portion 24*a* which are in fluid communication. The bottom end of the longitudinal tube portion 22*a* is connected to the inlet end 14 of the flexible tube 12 by means of complementary threads on the respective structures in the illustrated embodiments, although other ways of connecting them may be used. The top end of the longitudinal tube portion 22*a* is connected to a duplex adapter cap 30. The inside of the lateral tube portion 24*a* is provided with an annular sealing flange 32*a* towards the open outer end 33*a*. A hemispherical member 34*a* within the lateral tube portion 24*a* is seated against the sealing flange 32*a* as a result of a biasing force provided by spring 36*a*. The base of the spring 36*a* is seated against a retainer sleeve 38*a* that is snap-fit into the longitudinal tube portion 22*a*. The retainer sleeve 38*a* includes a port 40*a* that is adjacent the lateral tube portion 22*a* and allows fluid communication between the lateral tube portion 24*a* and the longitudinal tube portion 22*a*. Either the sealing flange 32*a*, the hemispherical member 34*a*, or both are preferably made of an elastomeric material to provide for an enhanced seal between them. The spring 36*a* is one that provides sufficient biasing force to seat the hemispherical member 34*a* against the sealing flange 32*a* under ambient conditions, but which allows the hemispherical member 34*a* to be drawn inwardly away from the sealing flange 32*a* as a result of negative pressure in the spout 10 caused by fluid flowing therethrough. Consequently, the breather valve assembly 18*a* functions to allow air to be drawn into the spout 10 to relieve any negative pressures within the spout, thereby preventing fluid lock in the spout and container.

In FIG. 7 is shown a variation of the breather valve in the breather valve assembly 18*b* with a conical member 34*b* instead of a hemispherical member 34*a*.

In FIGS. 8 and 9, a breather valve assembly 18*c* is shown, and comprises a T-junction tube 20*c* comprising of a longitudinal tube portion 22*c* and lateral tube portion 24*c* which are in fluid communication. The bottom end of the longitudinal tube portion 22*c* may be connected to the inlet end 14 by means of complementary threads on the respective structures in the illustrated embodiments, although other ways of connecting them are available. The top end of the longitudinal tube portion 22*c* is connected to a duplex adapter cap 30. The inside of the lateral tube portion 24*c* is provided with an annular sealing flange 32*c* towards the open outer end 33*c*. A flap member 34*c* having a hemispherical seal portion 35*c* is hinged by hinge pin 37*c* within the lateral tube portion 24*c* such that the hemispherical seal portion 35*c* abuts the sealing flange 32*c* as a result of a biasing force provided by spring 36*c*. The base of the spring 36*c* is seated against a retainer sleeve 38*c* that is snap-fit into the longitudinal tube portion 22*c*. The retainer sleeve 38*c* includes a port 40*c* that is adjacent the lateral tube portion 22*c* and allows fluid communication between the lateral tube portion 24*c* and the longitudinal tube portion 22*c*. Either the sealing flange 32*c*, hemispherical seal portion 35*c*, or both are preferably made of an elastomeric material to provide for an enhanced seal between them. The spring 36*c* is one that provides sufficient biasing force to seat the hemispherical seal portion 35*c* against the sealing flange 32*c* under ambient conditions, but which allows the flap member 34*c* to be drawn inwardly to swing away from the sealing flange 32*c* as a result of negative pressure in the spout 10 caused by fluid flowing therethrough. Consequently, the breather valve assembly 18*c* functions to allow air to be drawn into the spout 10 to relieve any negative pressures within the spout, thereby preventing fluid lock in the spout and container.

Figure 13:
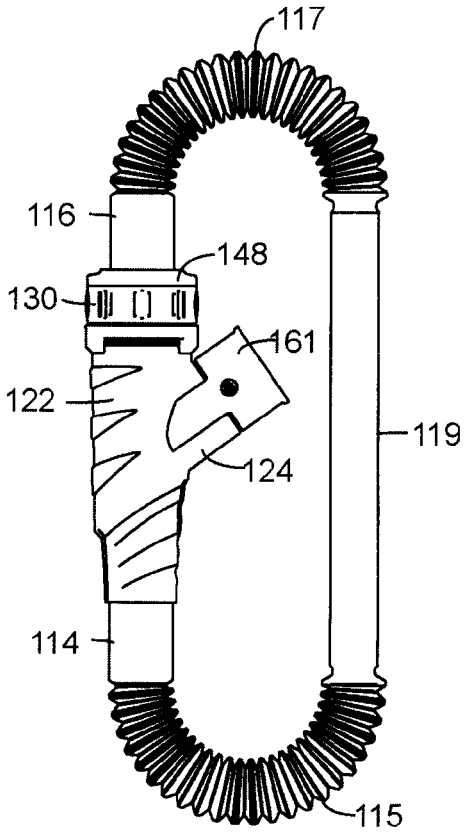
FIG. 13 is a side view of the flexible pouring spout shown in FIG. 11.
Figure 11:
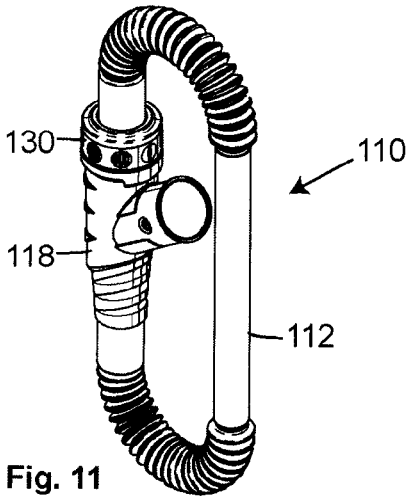
FIG. 11 is a perspective view of the flexible pouring spout of FIG. 10 shown coupled to itself to form a loop in the storage configuration.
Figure 16:
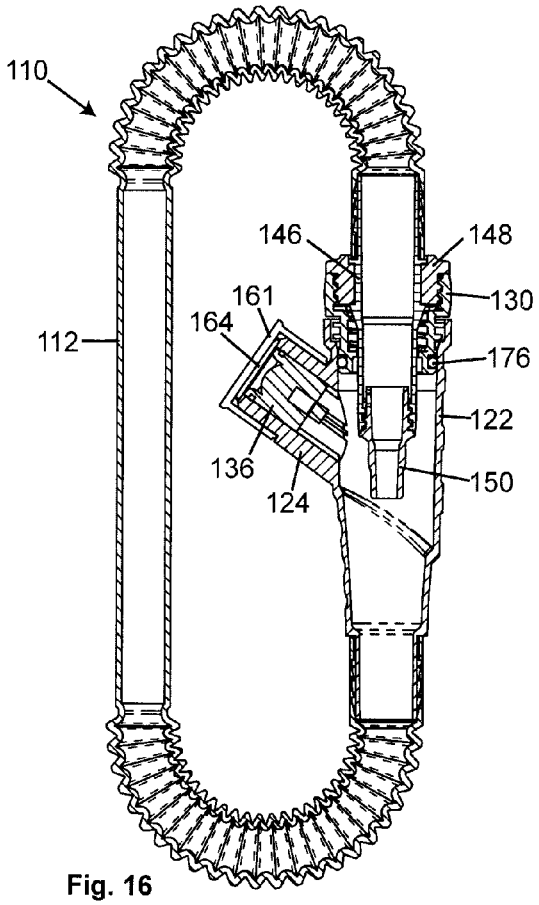
FIG. 16 is a longitudinal section view along plane A-A in FIG. 12.

While the embodiments as illustrated and described herein are of a spring biased one-way air inlet valve, in which air is allowed to be drawn into the device as a result of a negative pressure generated by fluid flowing through the device that overcomes the biasing force of the spring tending to close the valve, and which closes in the absence of fluid flowing through the device to limit the escape of fluid from the device via the valve, it should be apparent to the skilled reader that other sealable air inlet valve mechanisms may be used in other embodiments of the present invention. For example, a manually sealable air inlet valve may be used in which a sealing cap may be provided that cooperates with the sealable air inlet valve and that is moveable between an open position in which it allows air to be drawn into the valve and closed position in which it seals the valve to prevent fluid escape. Thereby, such sealable air inlet valve also allows air to be drawn into the device when the air inlet valve is open to facilitate a rapid flow of fluid through the device, and which prevents the escape of fluid through the air inlet valve when it is closed Referring to FIGS. 10-17, by reference characters, the flexible pouring spout 110 of the present invention includes a length of a hose or tubing 112 having a first end such as inlet end 114 and a terminal end such as outlet end 116. The tubing 112 may include two flexible convoluted portions 115 and 117, made of plastic or rubber, adjacent the inlet end 114 and the outlet end 116 respectively. A more resilient straight portion 119 may be provided in between flexible convoluted portions 115 and 117. This kind of structure imparts a relatively compact oval configuration to the spout 110 when it is looped upon itself in the storage configuration, as shown in FIGS. 11, 13 and 16. The tubing 112 could be made of various materials, and of course the material of which it is made must be selected to be inert to the fluid for which the spout is intended to be used. The flexible convoluted portions 115 and 117 each comprise a plurality of segments 160 joined to each other that enables these portions of the tubing 112 to be articulated.

At the inlet end 114 of the flexible tubing 112 is connected to a hollow body such as breather valve assembly 118. In the embodiment illustrated in FIGS. 10-17 the breather valve assembly 118 comprises an offset T-junction tube 120 comprising of a longitudinal tube portion 122 and lateral tube portion 124 that is angled upward. The longitudinal tube portion 122 and lateral tube portion 124 are in fluid communication. The bottom end of the longitudinal tube portion 122 is connected to the inlet end 114 by means of a tight fit of the inlet end 114 over the bottom end, and an adhesive may also be used in between these parts provided that it is chemically inert to the fluid for which the spout is intended to be used. Alternatively or in addition, complementary threads on the respective structures may be provided. It will be apparent to the skilled reader that other ways of connecting these parts may be used.

The top end of the longitudinal tube portion 122 is connected to a bottle or container adapter such as adapter cap 130 that has two (first and second) internal threaded portions 130*a* and 130*b* of different diameters, each matching the most commonly used oil container spout diameters and thread patterns, thereby enabling the duplex adapter cap 130 (hence the pouring spout 110) to be integrally connected to such popular oil containers. While the adapter cap 130 is shown having two internal threaded portions, this is not a requirement and other embodiments of the present invention may have an adapter cap with only one internally threaded portion, or with more than two internally threaded portions. Two sealing washers 131*a* and 131*b* are provided to fit in the base of the threaded portions 130*a* and 130*b* respectively. The duplex adapter cap 130 is configured such that one of washers 131*a* or 131*b* abuts the terminal edge on the container spout onto which the adapter cap 130 is threaded—depending on the size of container spout—when the flexible pour spout 110 is in use.

Figure 17:
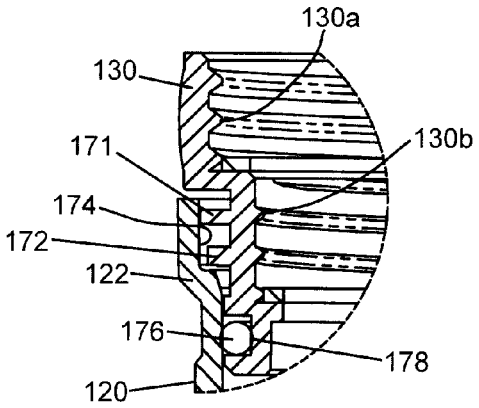
FIG. 17 is a close up of portion B in FIG. 15 showing detail of the duplex adapter cap.

The connection between the top end of the longitudinal tube portion 122 and the duplex adapter cap 130 is a rotatable connection such that the duplex adapter 130 may rotate relative to the longitudinal tube portion 122. This enables the duplex adapter cap 130 to be readily spun onto the threaded neck of the fluid container. With reference to FIG. 17, the rotatable connection is achieved in the illustrated embodiment by a pair of circumferential flanges 171 and 172 that are received within and engaged by channel 174 provided on the inside surface of the top end of the longitudinal tube portion 122. A fluid tight seal between the longitudinal tube portion 122 and the duplex adapter cap 130 is provided by an elastomeric O-ring 176 that is received within channel 178 provided adjacent the lower end of the duplex adapter cap 130 and that abuts the inside surface of an adjacent portion of the longitudinal tube portion 122. While a particular configuration of a rotatable connection between an adapter cap and a longitudinal tube portion is illustrated and described herein, it will henceforth become apparent to a skilled reader that other configurations are possible to provide a rotatable, yet fluid tight, connection between an adapter cap and a longitudinal tube portion. The important consideration is that if a rotatable connection is provided, it should be fluid tight with regard to the type of fluid for which the spout is designed to prevent leakage of said fluid from such rotatable connection.

Figure 14:
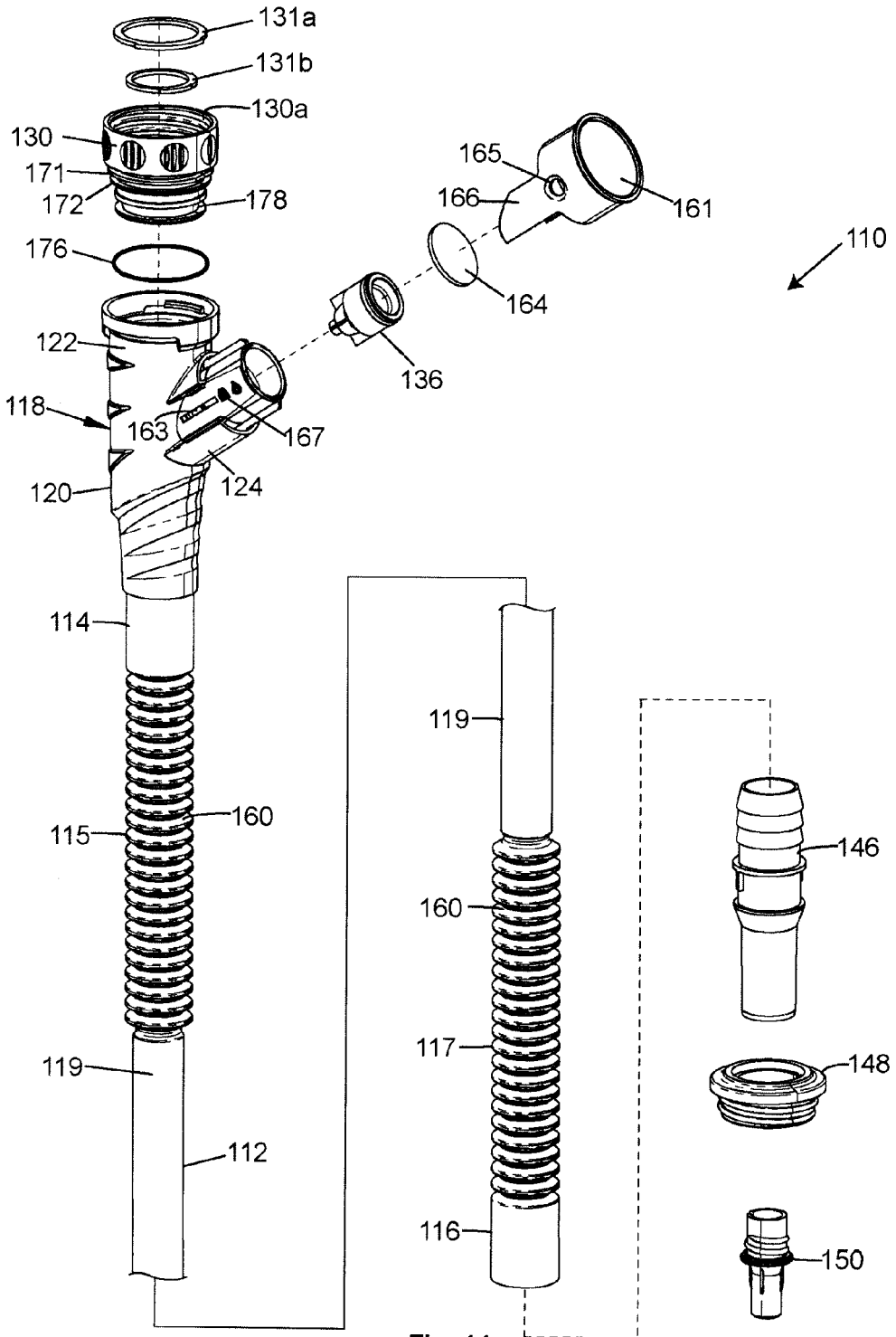
FIG. 14 is an exploded perspective view of the flexible pouring spout shown in FIG. 10.
Figure 15:
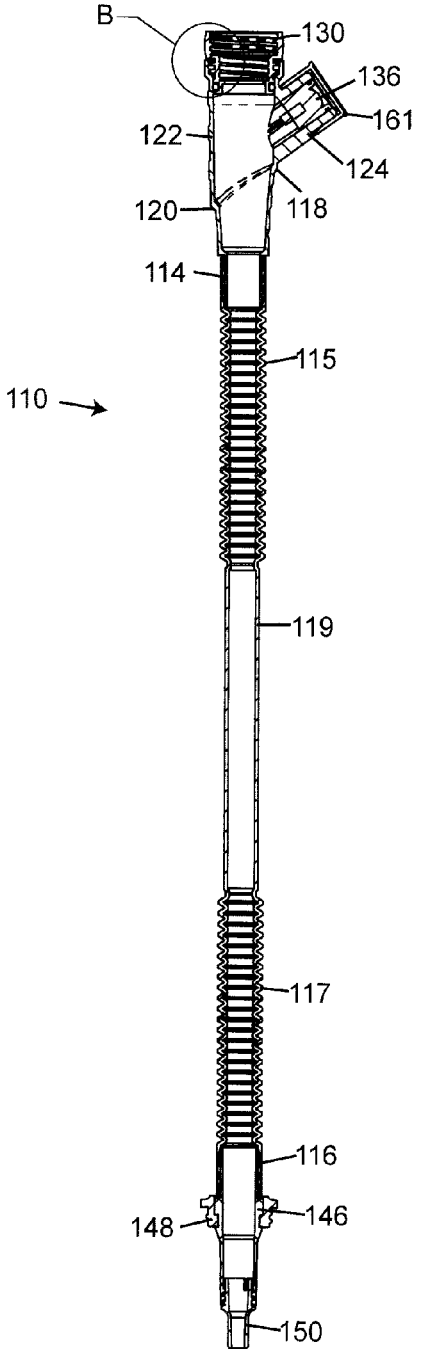
FIG. 15 is a longitudinal section view along plane A-A in FIG. 12 of the flexible pouring spout shown in an extended position.

Referring particularly to FIG. 14, into the inside of the lateral tube portion 124 is press-fit a spring biased one-way air inlet valve such check valve assembly 136, such as that manufactured and distributed by Neoperl GmbH of Germany (and related entities) under model number OF20 (at the time of filing of this application). The internal spring within the check valve assembly 136 should be such that it provides sufficient biasing force to seat the valve closed under ambient conditions but which allows the valve to be drawn open as a result of negative pressure in the spout 110 caused by fluid flowing there through, thereby allowing the check valve assembly 136 to draw air into the spout 110. Consequently, the check valve assembly 136 functions to allow air to be drawn into the spout 110 to relieve any negative pressures within the spout, thereby preventing fluid lock in the spout and container. While it has been found to be convenient to use an off-the-shelf, commercially available, one way check valve assembly as described, it will henceforth be apparent to the skilled reader that other suitable check valve assemblies may be used or other configurations of breather valves may be employed in the present invention, including some of the embodiments of breather air valves previously described herein. The important consideration is that the check valve or breather valve operate in a manner to be closed under ambient conditions (to prevent fluid leakage out of valve when the device is not in use), but be drawn open as a result of negative pressure in the flexible pour spout when fluid flows through the spout. The operation of the check valve or breather valve in this manner allows air to be drawn into the spout to release any negative pressures within the spout, thereby preventing fluid lock in the spout and container, and facilitating a rapid flow of fluid from the container into the desired receptacle on the motor vehicle (or otherwise as the case may be).

A breather cap 161 may be slidably mounted over the end of the lateral tube portion 124, for slidable movement relative thereto, to provide an additional sealing means for preventing the escape of fluid form the spout 110 via the check valve assembly 136. The breather cap 161 may be indexed between an open position, which allows air to be drawn in through the check valve assembly 136, and a closed position in which a flexible seal 162 on the inside of the breather cap 161 provides a fluid tight seal between the breather cap 161 and the lateral tube portion 124 to prevent the escape of fluid thereform. The indexing of the breather cap 161 may be provided by ramp portion 163 on an external surface of the lateral tube portion 124 that cooperates with a complementary protrusion (not shown) on the inside of a side portion 166 on the breather cap 161. In addition, cap position markings 167 may be provided to indicate the closed or open position of the breather cap 161 via a window opening 165 provided through the breather cap 161.

The flexible tubing 112 terminates in the outlet end 116 that is connected to a spout end 146 adapted for easy insertion in an opening or orifice of a fluid receptacle on a motor vehicle or the like. The spout end 146 includes a connector portion such as external annular threaded member 148 which is adapted to being threaded to the threaded portion 130*a* on the duplex adapter cap 130 such that the spout 110 may be coupled to itself to form a loop, thereby enclosing its internal surfaces when the spout 110 is not in use, as show in FIGS. 11-13 and 16. To accomplish this, the annular threaded member 148 is brought into contact with threads 130*a* on the adapter cap 130 and the adapter cap 130 is rotated (via the rotatable connection between an adapter cap and a longitudinal tube portion) to engage the threads on the annular threaded member 148. In this storage position the interior of the spout 110 will be sealed from contact with ambient dust or the like. Further, if these surfaces are oily, there will be no tendency for the liquid to drip from the spout 110 even when it is hung up or otherwise stored. Accordingly, the seal between the annular threaded member 148 and the duplex adapter cap 130 should be fluid tight with regard to the type of fluid for which the spout is designed to prevent leakage of said fluid from this connection. To use the spout 110 again, it is only necessary to unthread the annular threaded member 148 from the duplex adapter cap 130 by rotating the duplex adapter cap 130 so that threads 130*a* disengage the threads on the annular threaded member 148, and to connect the adapter cap to the threaded neck of an oil container.

The spout end 146 may be clear (i.e. comprised of a clear plastic) to enable a user to monitor the flow of fluid through the spout 110 and to know when the fluid container becomes empty. A transmission fluid end spout 150 having an elongate nozzle portion may also be provided for ease of filling transmissions with oil. The transmission fluid end spout 150 may be connectible to the spout end 146 and it may also be clear. In addition, the flexible tubing 112 may be made from a translucent elastomeric material which enables the monitoring of the flow of fluid through the spout 110.

While the embodiments as illustrated and described herein are of a spring biased one-way air inlet valve such as check valve assembly 136, in which air is allowed to be drawn into the device as a result of a negative pressure generated by fluid flowing through the device that overcomes the biasing force of the spring tending to close the valve, and which closes in the absence of fluid flowing through the device to limit the escape of fluid from the device via the valve, it should be apparent to the skilled reader that other sealable air inlet valve mechanisms may be used in other embodiments of the present invention. For example, a manually sealable air inlet valve may be used comprising of an opening—such as the opening of the lateral tube 124—which may be manually sealed and unsealed using a sealing cap such as breather cap 161 that is moveable between an open position in which it allows air to be drawn into the valve and closed position in which it seals the valve to prevent fluid escape. Thereby, such sealable air inlet valve also allows air to be drawn into the device when the air inlet valve is open to facilitate a rapid flow of fluid through the device, and which prevents the escape of fluid through the air inlet valve when it is closed.

Other aspects and features of the present invention will become apparent to those of ordinary skill in the art upon review of the following description of specific embodiments of the invention in conjunction with the accompanying figures.

While the above description and illustrations constitute preferred or alternate embodiments of the present invention, it will be appreciated that numerous variations may be made without departing from the scope of the invention. It is intended that the invention be construed as including all such modifications and alterations.

What is claimed is:

1. A flexible pouring spout for pouring fluids from a container with a threaded neck portion into an orifice, the flexible pour spout comprising:

a container adapter having a first threaded portion having internal threads and being adapted to connect with the threaded neck portion of the fluid container;

a hollow body connected to the container adapter and in fluid communication therewith;

an elongate flexible tube having a first end connected to the hollow body and in fluid communication therewith, and a terminal end being suitable for insertion into the orifice, the tube having a length sufficient to enable the terminal end to being inserted into the container adapter when the device is not in use, thereby defining a storage configuration;

a tubular extension branching laterally from the hollow body and being in fluid communication therewith, and a sealable air inlet valve mounted in the tubular extension that allows air to be drawn into the tubular extension when the air inlet valve is open to facilitate a rapid flow of fluid through the device, and which prevents the escape of fluid through the air inlet valve when it is closed, wherein the sealable air inlet valve is wholly contained in the tubular extension so as not to intrude into the hollow body; and a connector portion attached to the terminal end and having external threads that are adapted to engage the internal threads of the container adapter when the terminal end is inserted into the container adapter in a manner that provides a fluid tight seal between the container adapter and the connector portion, or between the container adapter and the terminal end, to prevent fluid from escaping from the device when it is in the storage configuration.

2. The device of claim 1 wherein the sealable air inlet valve comprises a spring biased one-way inlet valve which allows air to be drawn into the device as a result of a negative pressure generated by fluid flowing through the device that overcomes a biasing force of the spring tending to close the valve, and which closes in the absence of fluid flowing through the device to limit the escape of fluid from the device via the valve.

3. The device of any one of claims 1 and 2, wherein the container adapter includes a second threaded portion having internal threads of smaller size from the first threaded portion and being adapted to connecting with a smaller sized threaded neck of a fluid container than the first threaded portion.

4. The device of claim 3, wherein the container adapter is rotatably connected to the hollow body in a manner that provides a fluid tight seal between them but which enables the container adapter to rotate relative to the rest of the device to facilitate connecting the container adapter to the container when the device is intended to be used, or to the connector portion when the device is intended to be stored.

5. The device of claim 4, further comprising a sealing cap that cooperates with the tubular extension and that is moveable between an open position in which it allows air to be drawn into the tubular extension and a closed position in which it seals the tubular extension to prevent fluid escape.

6. The device of claim 3, wherein the elongate flexible tube comprises a first flexible corrugated portion adjacent the first end, a second flexible corrugated portion adjacent the terminal end, and a resilient straight portion in between said first and second corrugated portions to maintain the device in a generally oval shape when in the storage configuration.

7. The device of claim 3 wherein the connector portion comprises an annular member mounted around a portion of the terminal end, the annular member having a circumferential flange portion that in the storage configuration abuts an end of the container adapter adjacent the first threaded portion in a manner to provide a liquid tight seal around the first threaded portion.

8. The device of claim 7, further comprising a sealing cap that cooperates with the tubular extension and that is moveable between an open position in which it allows air to be drawn into the tubular extension and a closed position in which it seals the tubular extension to prevent fluid escape.

9. The device of claim 8, wherein the elongate flexible tube comprises a first flexible corrugated portion adjacent the first end, a second flexible corrugated portion adjacent the terminal end, and a resilient straight portion in between said first and second corrugated portions to maintain the device in a generally oval shape when in the storage configuration.

* * * * *